US011177546B2

(12) United States Patent
Li et al.

(10) Patent No.: US 11,177,546 B2
(45) Date of Patent: Nov. 16, 2021

(54) BANDPASS FILTER BASED ON EFFECTIVE LOCALIZED SURFACE PLASMONS AND OPERATION METHOD THEREOF

(71) Applicant: Nanjing University of Aeronautics and Astronautics, Nanjing (CN)

(72) Inventors: Zhuo Li, Nanjing (CN); Yaru Yu, Nanjing (CN); Yulei Ji, Nanjing (CN); Qi Jiang, Nanjing (CN); Yufan Zhao, Nanjing (CN)

(73) Assignee: Nanjing University of Aeronautics and Astronautics, Nanjing (CN)

( * ) Notice: Subject to any disclaimer, the term of this patent is extended or adjusted under 35 U.S.C. 154(b) by 0 days.

(21) Appl. No.: 17/127,251

(22) Filed: Dec. 18, 2020

(65) Prior Publication Data

US 2021/0194103 A1 Jun. 24, 2021

(30) Foreign Application Priority Data

Dec. 20, 2019 (CN) ..... 201911323718.3

(51) Int. Cl.
*H01P 1/203* (2006.01)
*H01P 1/20* (2006.01)

(52) U.S. Cl.
CPC ..... *H01P 1/203* (2013.01); *H01P 1/20* (2013.01)

(58) Field of Classification Search
CPC .. H01P 1/203; H01P 1/20309; H01P 1/20327; H01P 1/20354; H01P 1/20336; H01P 1/20363; H01P 1/20381; H01P 1/20; H01P 1/201; H01P 1/2013
USPC ..... 333/204, 205
See application file for complete search history.

(56) References Cited

U.S. PATENT DOCUMENTS 5,616,538 A * 4/1997 Hey-Shipton ..... H01P 1/20363 505/210
6,597,265 B2 * 7/2003 Liang ..... H01P 1/20336 333/204
2003/0080834 A1 * 5/2003 Grunewald ..... H01P 1/20336 333/204

* cited by examiner

*Primary Examiner* — Stephen E. Jones
(74) *Attorney, Agent, or Firm* — Katherine Koenig; Koenig IP Works, PLLC

(57) ABSTRACT

The present disclosure provides a bandpass filter based on effective localized surface plasmons (ELSPs) and an operation method thereof. The bandpass filter includes a metal ground plane on a lower portion and a dielectric substrate in a middle as well as microstrips and dielectric resonators on an upper portion, where the microstrips at two terminals are symmetric with each other; each dielectric resonator includes a cuboid dielectric body and two metal strips, where the two metal strips each the same as the cuboid dielectric body in length are respectively located in a middle of an upper surface and lower surface of the dielectric body; and two microstrips are respectively connected to the metal strips on lower surfaces of two dielectric resonators, so as to be used as ports for feeding.

4 Claims, 3 Drawing Sheets

BANDPASS FILTER BASED ON EFFECTIVE LOCALIZED SURFACE PLASMONS AND OPERATION METHOD THEREOF

CROSS-REFERENCE TO RELATED APPLICATIONS

This application is related to and claims priority to Chinese Application Number 201911323718.3, entitled BANDPASS FILTER BASED ON EFFECTIVE LOCALIZED SURFACE PLASMONS AND OPERATION METHOD THEREOF, filed Dec. 20, 2019, the entirety of which is incorporated herein by reference.

GOVERNMENT RIGHTS STATEMENT

N/A.

FIELD

The present disclosure relates to a bandpass filter based on effective localized surface plasmons (ELSPs) and an operation method thereof, belonging to the technical field of miniaturized bandpass filters.

BACKGROUND

With the rapid development of wireless technologies, spectrum resources are increasingly crowded, such that higher performance of filters is required. That is, the filters need to be miniaturized and easily integrated and have low insertion losses, high in-band selectivity, and high out-of-band rejection. Therefore, a focus in a modern wireless communication field is to design miniaturized and high-efficiency filters. There are mainly waveguide filters, coaxial filters, microstrip filters, and dielectric resonator filters from radio frequency band to microwave band. The microstrip filters can be easily integrated with monolithic microwave integrated circuits (MMIC), printed circuit boards (PCB), and other integrated circuits. However, the microstrip filters have a quite low unloaded quality factor (Q) which is no more than 200 in general, and the unloaded Q will even be lower with an increase in frequencies due to a decrease in skin depths in metals. Consequentially, the filters will have increased in-band insertion losses. Dielectric resonators have quite high Q factors and low insertion losses, and thus the dielectric resonator filters have quite high selectivity. However, the dielectric resonator filters are difficult to integrate due to a three-dimensional structure of the dielectric resonators.

Surface plasmons mainly include propagating surface plasmon polaritons (SPPs) and localized surface plasmons (LSPs) on surfaces of metal nanoparticles, where the SPPs refer to electromagnetic waves generated by means of coupling of incident photons and free electrons on surfaces of metals, and the LSPs refer to a mixed excited state formed by coupling of the incident photons and free electrons in closed metal nanoparticles. The nanometer-scale SPPs and LSPs can achieve field enhancement and electromagnetic wave confinement and are mainly applied to interfaces between the metals (such as gold, silver, and the like) and dielectrics (such as air). Since the plasma frequency of the metals is typically regarded to be in a band between infrared and ultraviolet, in a lower band (microwaves and terahertz waves), the metals are approximately regarded as perfect electrical conductors (PECs), and electromagnetic waves are rapidly attenuated in the metals and thus are not prone to penetrating into the metals; and consequentially, the electromagnetic waves will have quite poor confinement on the surfaces of the metals. As a result, the propagating SPPs and the LSPs are almost impossible to be excited on the interfaces between the metals and the media at microwave and terahertz frequencies.

In recent ten years, scholars have expanded the application range of surface plasmons with great efforts to extend excellent characteristics of the surface plasmons to the low band, and have obtained great progress. Microwave and terahertz devices based on ELSPs can improve performance of traditional devices, and effectively expand bands in which the surface plasmons are available, thus achieving some new electromagnetic characteristics and new functions.

SUMMARY

The technical issue to be settled by the present disclosure is to provide a bandpass filter based on ELSPs and an operation method thereof to solve the problem that planarization and high Q factors of filters in the prior art cannot be both achieved, reduce the size of the filters, and make high-performance filters planar and miniaturized.

To settle the above technical issue, the present disclosure adopts the following technical solution:

The bandpass filter based on ELSPs includes a metal ground plane on a lower portion and a dielectric substrate in a middle as well as a first microstrip, a second microstrip, and at least two dielectric resonators on an upper portion, where the metal ground plane and the dielectric substrate are rectangular and have the same size; an upper surface of the metal ground plane is in contact with the lower surface of the dielectric substrate; each dielectric resonator includes a cuboid dielectric body and two metal strips, where the two metal strips are respectively located in a middle of an upper surface and lower surface of the cuboid dielectric body and are parallel to long edges of the cuboid dielectric body, and the cuboid dielectric body the same as each metal strip in length is wider than the metal strip and has a lower surface in contact with an upper surface of the dielectric substrate; the dielectric resonators are linearly arranged in the middle of the dielectric substrate, and the long edges of each cuboid dielectric body are parallel to wide edges of the dielectric substrate; the first microstrip and the second microstrip have the same size and have lower surfaces in contact with the upper surface of the dielectric substrate and are parallel to long edges of the dielectric substrate, and the first microstrip is symmetric with the second microstrip relative to a centerline of the long edges of the dielectric substrate; and moreover, the first microstrip has a left terminal aligned to a left terminal of the dielectric substrate as well as a right terminal connected to the metal strip on a lower surface of the dielectric resonator closest to the left terminal of the dielectric substrate, and the second microstrip has a right terminal aligned to a right terminal of the dielectric substrate as well as a left terminal connected to the metal strip on a lower surface of the dielectric resonator closest to the right terminal of the dielectric substrate.

Preferably, a high-frequency circuit board Rogers5880 may be adopted as the dielectric substrate.

Preferably, each cuboid dielectric body may be made from ceramic materials.

An operation method of the bandpass filter based on ELSPs is implemented according to the bandpass filter based on ELSPs as follows: the first microstrip and the second microstrip are respectively connected to the metal strips on the lower surfaces of the dielectric resonators, so as to be used as ports for feeding; in a case where one microstrip is selected as an input terminal/output terminal of the bandpass filter, the other microstrip is used as an output terminal/input terminal of the bandpass filter; and an operating frequency of the bandpass filter is adjusted by means of a change to a length and dielectric constant of the dielectric resonators, coupling strength of the ports is adjusted by means of a change to feeding points of the first microstrip and the second microstrip, and coupling strength of the dielectric resonators is adjusted by means of a change to a distance between every two adjacent resonators.

Compared with the prior art, the present disclosure adopting the above technical solution has the following technical effects:

1. An ELSPs technology is adopted; and in this way, the dielectric resonators in the present disclosure have a resonant frequency considerably lower than that of common dielectric resonators if being the same as the common dielectric resonators in size, so that the bandpass filter is greatly reduced in size. Furthermore, the operating frequency and bandwidth of the filter can be adjusted by means of the change to the length and dielectric constant of the dielectric resonators.

2. The operating frequency of the bandpass filter based on ELSPs is almost not influenced by a change to the size of cross sections of the dielectric resonators. Therefore, as long as relevant manufacturing processes are available, a thickness can reach a technical limit value, and a high degree of planarization can be achieved.

3. The bandpass filter based on ELSPs retains high Q factors of dielectric resonator filters and has high selectivity; and furthermore, the bandpass filter can be planar like microstrip filters and is easy to integrate.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

Figure 1:
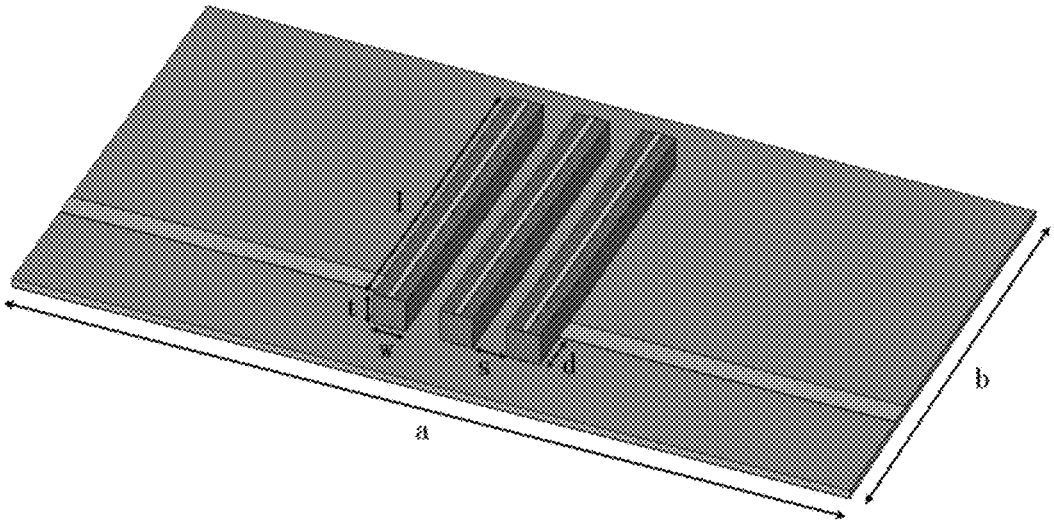
FIG. 1 is an overall structural diagram of a bandpass filter based on ELSPs of the present disclosure.

The implementations of the present disclosure are described in detail below with reference to the accompanying drawings. The reference numerals of the implementations are shown in the accompanying drawings. The embodiments described below with reference to the accompanying drawings are exemplary, and are only used to explain the present disclosure but should not be construed as a limitation to the present disclosure.

Research indicates that ELSPs can emulate, in a low band, real LSPs in an optical band more effectively. Metal strips are respectively arranged on an upper surface and lower surface of a dielectric body, so that an interface between the dielectric body and air can support an LSPs mode which is similar to that generated by irradiating metals with optical waves in the optical band, and only a dipolar mode is available; and in this way, an excellent characteristic of height field localization of the LSPs is extended to a microwave band and a terahertz band. In addition, a miniaturized bandpass filter can be designed based on the dipolar mode of the ELSPs.

As shown in FIG. 1, a bandpass filter based on ELSPs of the present disclosure includes a metal ground plane on a lower portion and a dielectric substrate in a middle as well as a first microstrip, a second microstrip, and at least two dielectric resonators on an upper portion, where the first microstrip and second microstrip at two terminals are symmetric with each other; the metal ground plane and the dielectric substrate are rectangular and have the same size; an upper surface of the metal ground plane is in contact with the lower surface of the dielectric substrate; each dielectric resonator includes a cuboid dielectric body and two metal strips, where the two metal strips are respectively located in a middle of an upper surface and lower surface of the cuboid dielectric body and are parallel to long edges of the cuboid dielectric body, and the cuboid dielectric body the same as each metal strip in length is wider than the metal strip and has a lower surface in contact with an upper surface of the dielectric substrate; the dielectric resonators are linearly arranged in the middle of the dielectric substrate, and the long edges of each cuboid dielectric body are parallel to wide edges of the dielectric substrate; the first microstrip and the second microstrip have the same size and have lower surfaces in contact with the upper surface of the dielectric substrate and are parallel to long edges of the dielectric substrate, and the first microstrip is symmetric with the second microstrip relative to a centerline of the long edges of the dielectric substrate; and moreover, the first microstrip has a left terminal aligned to a left terminal of the dielectric substrate as well as a right terminal connected to the metal strip on a lower surface of the dielectric resonator closest to the left terminal of the dielectric substrate, and the second microstrip has a right terminal aligned to a right terminal of the dielectric substrate as well as a left terminal connected to the metal strip on a lower surface of the dielectric resonator closest to the right terminal of the dielectric substrate. In addition, the two microstrips are respectively connected to the metal strips on the lower surfaces of the dielectric resonators closest to the left terminal and right terminal of the dielectric substrate, so as to be used as ports for feeding.

The dielectric substrate in the middle has a model denoted by Rogers 5880, a dielectric constant denoted by $\varepsilon r1$ and equal to 2.2, a length denoted by a, a width denoted by b, and a thickness denoted by h and equal to 0.254 mm; the thickness of the metal ground plane on the lower portion as well as the thickness of each microstrip on the upper portion is denoted by c and equal to 0.018 mm; and port impedance of the microstrips is ensured to be 50 ohm by size parameters of the metal ground plane on the lower portion, the dielectric substrate in the middle, and the microstrips.

The dielectric body of each dielectric resonator has a loss tangent denoted by tan $\sigma$ and equal to 1.5*(10−4), a length denoted by l, a width denoted by w, and a thickness denoted by t, and is made from ceramic materials having a dielectric constant denoted by εr2 and equal to 37; each metal strip has a length denoted by l, a width denoted by m and equal to 0.2 mm, and a thickness denoted by c and equal to 0.018 mm; a distance between every two adjacent resonators is denoted by s; and a displacement of a feeding point on each microstrip is denoted by d.

Figure 2:
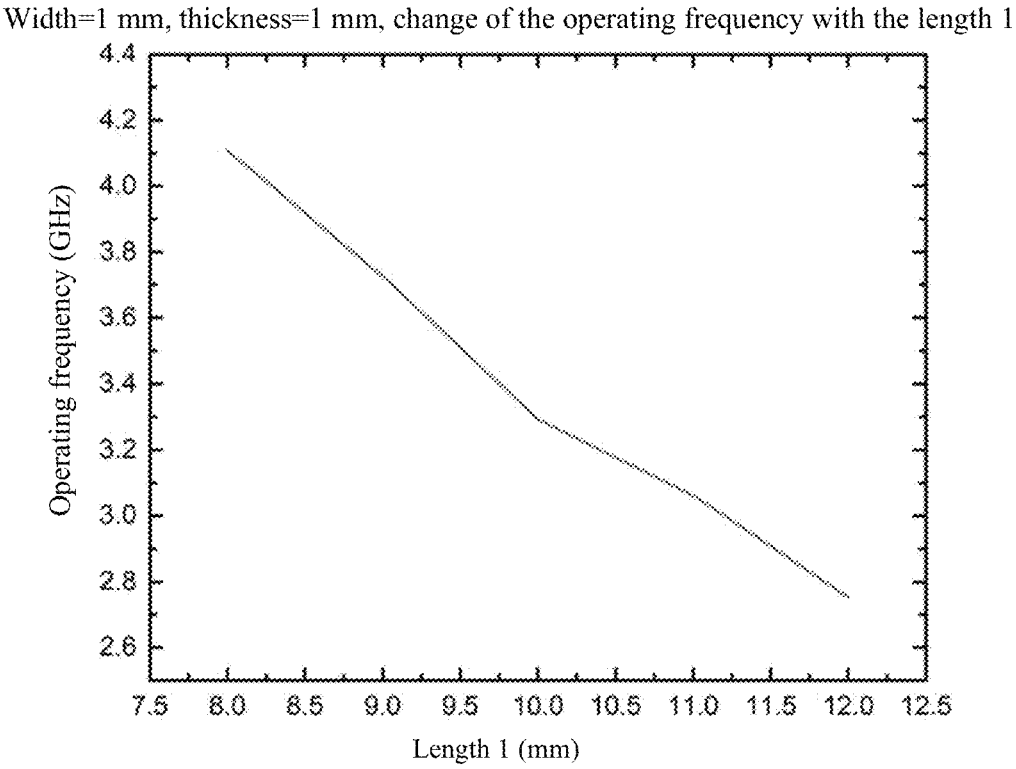
FIG. 2 is a change curve of an operating frequency with a length 1 of a dielectric resonator in a case where the dielectric resonator has a width w of 1 mm and a thickness t of 1 mm.
Figure 3:
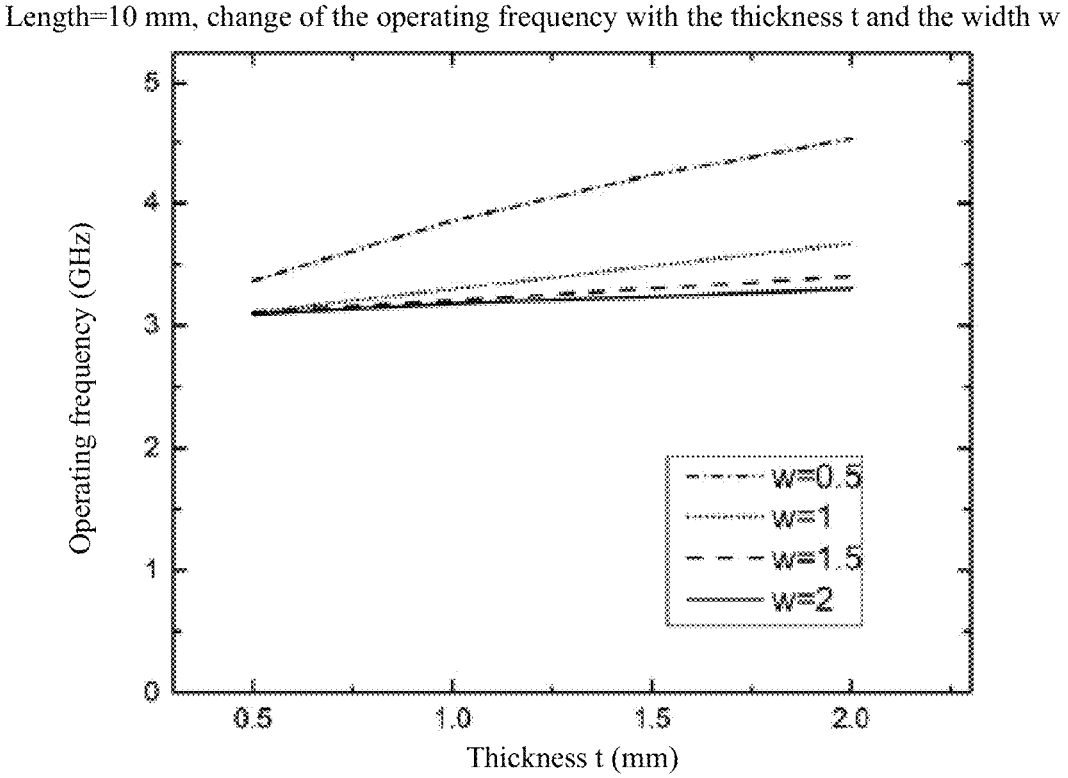
FIG. 3 is a change curve of the operating frequency with the width w and the thickness t in a case where the length of the dielectric resonator is 10 mm.

FIG. 2 shows a change curve of an operating frequency with the length l of each dielectric resonator in a case where the dielectric resonator has the width w of 1 mm and the thickness t of 1 mm. FIG. 3 shows a change curve of the operating frequency with the width w and the thickness t in a case where the length of each dielectric resonator is 10 mm. As shown in FIG. 2 and FIG. 3, the operating frequency of the bandpass filter based on ELSPs is obviously influenced by a change to the length of the dielectric resonator and is almost not influenced by a change to the width and thickness of the dielectric resonator.

Figure 4:
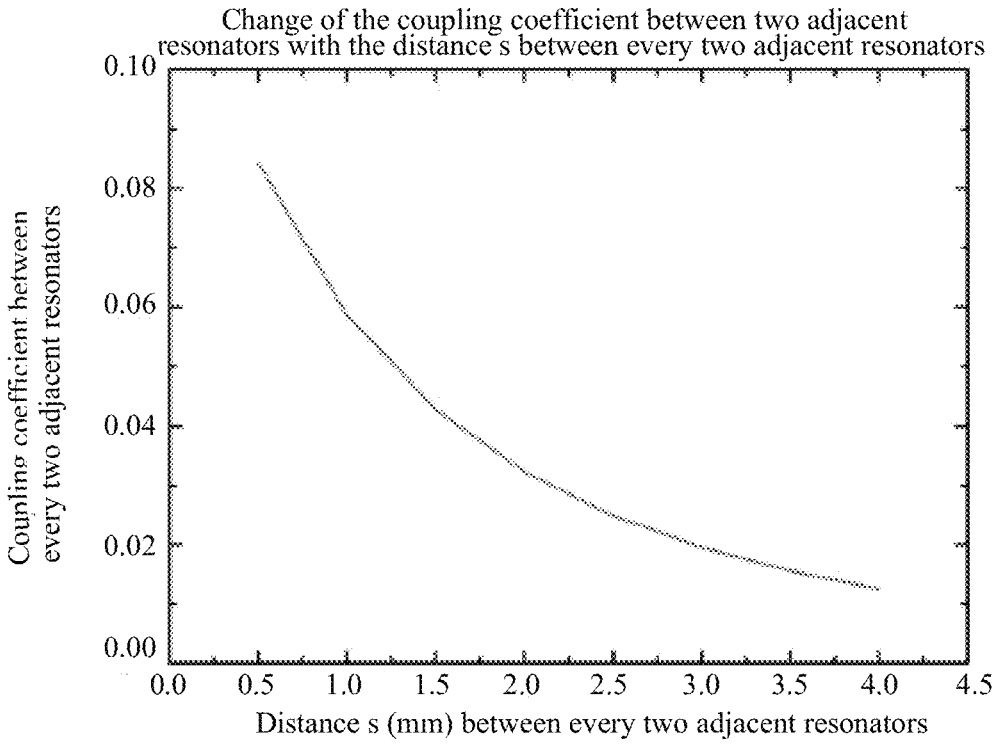
FIG. 4 is a change curve of a coupling coefficient between every two adjacent resonators with a distance between every two adjacent resonators.
Figure 5:
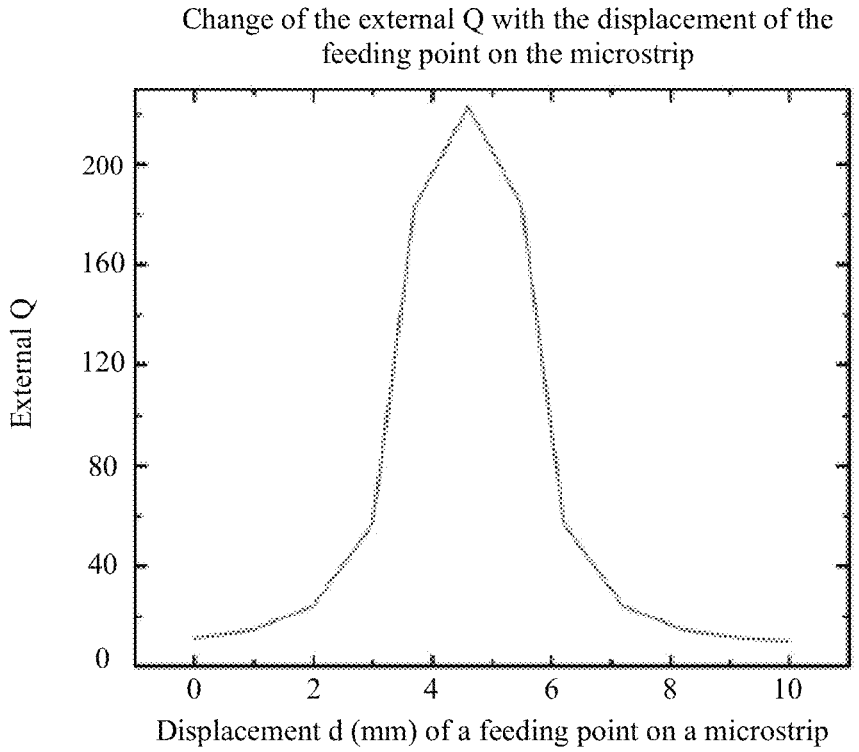
FIG. 5 is a change curve of an external Q with a displacement d of a feeding point on a microstrip.

FIG. 4 shows a change curve of a coupling coefficient between every two adjacent resonators with the distance between every two adjacent resonators. FIG. 5 shows a change curve of an external Q with the displacement d of the feeding point on each microstrip. As shown in FIG. 4 and FIG. 5, the coupling coefficient between every two adjacent resonators is increasingly reduced with an increase in the distance between every two adjacent resonators; and the maximum external Q is obtained when the feeding point on each microstrip is located in the middle of the corresponding resonator, and the minimum external Q is obtained when the feeding point is located at two terminals of the resonator.

TABLE 1

| Parameter | a | b | h | c | l | w | t | m | s | d |
|---|---|---|---|---|---|---|---|---|---|---|
| Value (mm) | 25 | 14 | 0.254 | 0.018 | 10 | 1 | 1 | 0.2 | 1 | 1.4 |

Figure 6:
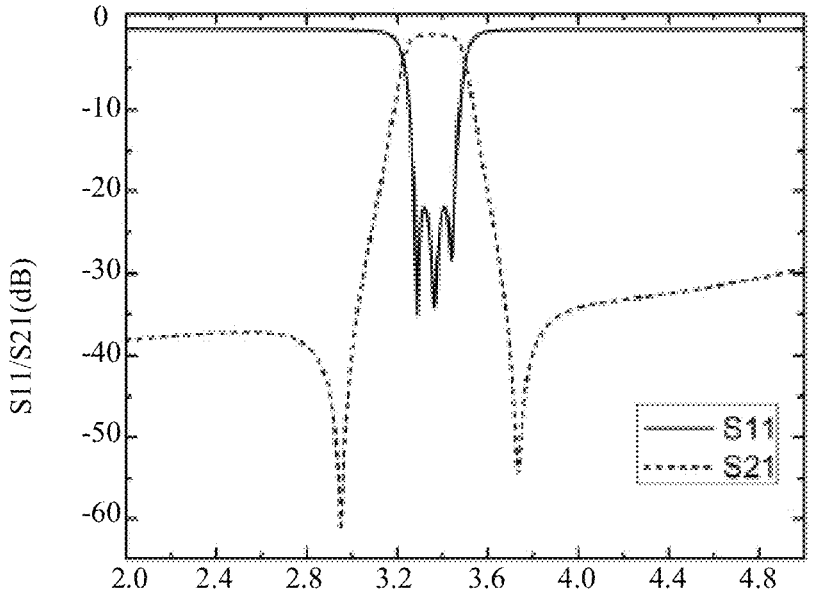
FIG. 6 is a parameter s simulated by the filter in an embodiment of the present disclosure.

Table 1 shows parameters of the filter in an embodiment of the present disclosure. A corresponding parameter s is obtained by means of a time domain solver of electromagnetic simulation software, namely a computer simulation technology (CST STUDIO). FIG. 6 shows that when the operating frequency is 3.36 GHz, a relative bandwidth is 5.4%, an in-band insertion loss is less than 0.8 dB, and a return loss is greater than 20 dB.

The foregoing embodiments are merely intended to illustrate the technical ideas of the present disclosure, rather than limiting the protection scope of the present disclosure. Any variations made according to the technical solutions based on the technical ideas proposed by the present disclosure should fall within the protection scope of the present disclosure.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention.

What is claimed is:

1. A bandpass filter based on effective localized surface plasmons (ELSPs), comprising a metal ground plane on a lower portion and a dielectric substrate in a middle as well as a first microstrip, a second microstrip, and at least two dielectric resonators on an upper portion, wherein the metal ground plane and the dielectric substrate are rectangular and have a same size; an upper surface of the metal ground plane is in contact with the lower surface of the dielectric substrate; each said dielectric resonator comprises a cuboid dielectric body and two metal strips, wherein the two metal strips are respectively located in a middle of an upper surface and lower surface of the cuboid dielectric body and are parallel to long edges of the cuboid dielectric body, and the cuboid dielectric body is the same as each said metal strip in length and is wider than the metal strip and has a lower surface in contact with an upper surface of the dielectric substrate; the dielectric resonators are linearly arranged in a middle of the dielectric substrate, and the long edges of each said cuboid dielectric body are parallel to wide edges of the dielectric substrate; the first microstrip and the second microstrip have the same size and have lower surfaces in contact with the upper surface of the dielectric substrate and are parallel to long edges of the dielectric substrate, and the first microstrip is symmetric with the second microstrip relative to a centerline of the long edges of the dielectric substrate; and moreover, the first microstrip has a left terminal aligned to a left terminal of the dielectric substrate as well as a right terminal connected to the metal strip on a lower surface of the dielectric resonator closest to the left terminal of the dielectric substrate, and the second microstrip has a right terminal aligned to a right terminal of the dielectric substrate as well as a left terminal connected to the metal strip on a lower surface of the dielectric resonator closest to the right terminal of the dielectric substrate.

2. The bandpass filter based on ELSPs according to claim 1, wherein a high-frequency circuit board Rogers5880 is adopted as the dielectric substrate.

3. The bandpass filter based on ELSPs according to claim 1, wherein each said cuboid dielectric body is made from ceramic materials.

4. An operation method of a bandpass filter based on ELSPs, being implemented according to the bandpass filter based on ELSPs according to claim 1, wherein the first microstrip and the second microstrip are respectively connected to the metal strips on the lower surfaces of the dielectric resonators, so as to be used as ports for feeding; in a case where one microstrip is selected as an input terminal/output terminal of the bandpass filter, the other microstrip is used as an output terminal/input terminal of the bandpass filter; and an operating frequency of the bandpass filter is adjusted by means of a change to a length and dielectric constant of the dielectric resonators, coupling strength of the ports is adjusted by means of a change to feeding points of the first microstrip and the second microstrip, and coupling strength of the dielectric resonators is adjusted by means of a change to a distance between every two adjacent resonators.

* * * * *